US008940989B1

(12) United States Patent
Spriggel

(10) Patent No.: US 8,940,989 B1
(45) Date of Patent: Jan. 27, 2015

(54) PERCUSSION MUSICAL INSTRUMENT

(71) Applicant: Daniel John Spriggel, Bermuda Dunes, CA (US)

(72) Inventor: Daniel John Spriggel, Bermuda Dunes, CA (US)

( * ) Notice: Subject to any disclaimer, the term of this patent is extended or adjusted under 35 U.S.C. 154(b) by 252 days.

(21) Appl. No.: 13/694,293

(22) Filed: Nov. 16, 2012

(51) Int. Cl.
*G10D 13/02* (2006.01)
*G10D 13/06* (2006.01)

(52) U.S. Cl.
CPC ..... *G10D 13/065* (2013.01)
USPC ..... 84/422.3

(58) Field of Classification Search
CPC ..... G10D 13/065; G10D 13/06
USPC ..... 84/422.3
See application file for complete search history.

(56) References Cited

U.S. PATENT DOCUMENTS

| | | | | |
|---|---|---|---|---|
| 1,596,495 | A | 8/1926 | Lalonde | |
| 3,893,363 | A | 7/1975 | Cohen | |
| 4,111,095 | A | 9/1978 | Simons | |
| 4,177,709 | A * | 12/1979 | Adams | 84/422.3 |
| 4,528,888 | A * | 7/1985 | Hoshino | 84/421 |
| 6,177,621 | B1 | 1/2001 | Hoshino | |
| 6,331,667 | B1 | 12/2001 | Küppers | |
| 6,417,434 | B1 | 7/2002 | Lao | |
| 7,276,654 | B1 | 10/2007 | Parisi | |

FOREIGN PATENT DOCUMENTS

JP 411143458 A 5/1999

* cited by examiner

*Primary Examiner* — Jianchun Qin
(74) *Attorney, Agent, or Firm* — Jack C. Munro

(57) ABSTRACT

A percussion musical instrument which utilizes a cymbal plate mounted on a shaft (or rod) in a spaced relationship from a cymbal also mounted on the shaft forming an annular gap. A tip of a drumstick is to be inserted within the annular gap and then moved to strike the cymbal plate and cymbal in a single stroke producing a pair of sounds of selected pitches which is to be quickly repeated producing a musical beat.

12 Claims, 14 Drawing Sheets

146
19
152
144

144
19
150
146
144
148

152
98
146
21
152
144

144
21
150
146
144
148

152
98
146
23
152
144

144
23
150
146
144
148

152
98

PERCUSSION MUSICAL INSTRUMENT

REFERENCE TO PROVISIONAL APPLICATION

The subject matter of this disclosure was broadly disclosed in U.S. provisional filing 61/629,433, filed Nov. 18, 2011, entitled Cymbal Mounting and Tuning Structure, by the present inventor.

BACKGROUND OF THE INVENTION

1. Field of the Invention

This invention constitutes a percussion musical instrument using a conventional cymbal stand on which has been added an additional cymbal which is to be tunable.

2. Description of the Prior Art

Pairs of cymbals, commonly called hi-hats, are used by drummers. The hi-hats are mounted on a shaft or rod of a vertical stand. One cymbal is fixed on the rod and the other cymbal is movable on the rod by a foot operated pedal which will move the upper cymbal of the pair of cymbals to clash with the lower cymbal producing a sound. Hi-hats are commonly used by drummers in conjunction with other musical instruments such as different types of drums. The upper cymbal can also be struck by a drumstick to produce a sound.

The present inventor has noticed that a single strike motion (stroke) of a drumstick comprises a slight upper upward movement of the drumstick and then a downward movement causing the drumstick to strike the upper cymbal. This action is to be repeated many times just to produce the desired percussion beat for the song. To produce a rapid beat will require the drummer to use both hands and two drumsticks. Playing of the drums is not possible because both hands of the drummer are in use. Most often the playing of the drums is required in conjunction with the cymbals for most songs.

Normally the upward motion of the drumstick is not used to produce any sound. However, if this upward motion of the drumstick could be used, then the number of beats could be doubled. For example, let it be assumed that a particular song requires fifty beats on the upper cymbal in a short burst of time such as two to three seconds. In the past this fifty beats required the drummer to use both hands and two drumsticks. However, if a single drumstick could be used to strike a separate cymbal plate when moving upward, then the fifty beats could be produced with one hand of the drummer and twice as many beats are produced in the two to three seconds leaving the drummer's other hand to strike the drums.

SUMMARY OF THE INVENTION

The structure of the present invention relates to the incorporation of a cymbal plate on the shaft or rod of a conventional cymbal stand. The cymbal plate is mounted two to three inches above the upper cymbal of a hi-hat. The hi-hat comprises an upper cymbal and a lower cymbal. The drummer inserts the tip of the drumstick in the annular space between the upper cymbal and the cymbal plate. Rapid moving of the drumstick will produce multiple sounds called a beat.

It is also desirable to have the sound produced from the cymbal plate to "match" the sound produced from the upper cymbal. To achieve this matching there is incorporated with the cymbal plate a tuning structure. Adjusting of the tuning structure changes the emitted tone until the desired tone is achieved by the drummer.

The primary objective of this invention is to produce twice as many beats within a cymbal percussion instrument within a given amount of time when compared to a conventional cymbal mounting arrangement.

Another objective of this invention is to provide a tuning structure in conjunction with a cymbal arrangement mounted on a stand in order to change the tone of the produced beats.

DETAILED DESCRIPTION OF THE INVENTION

Figure 1:
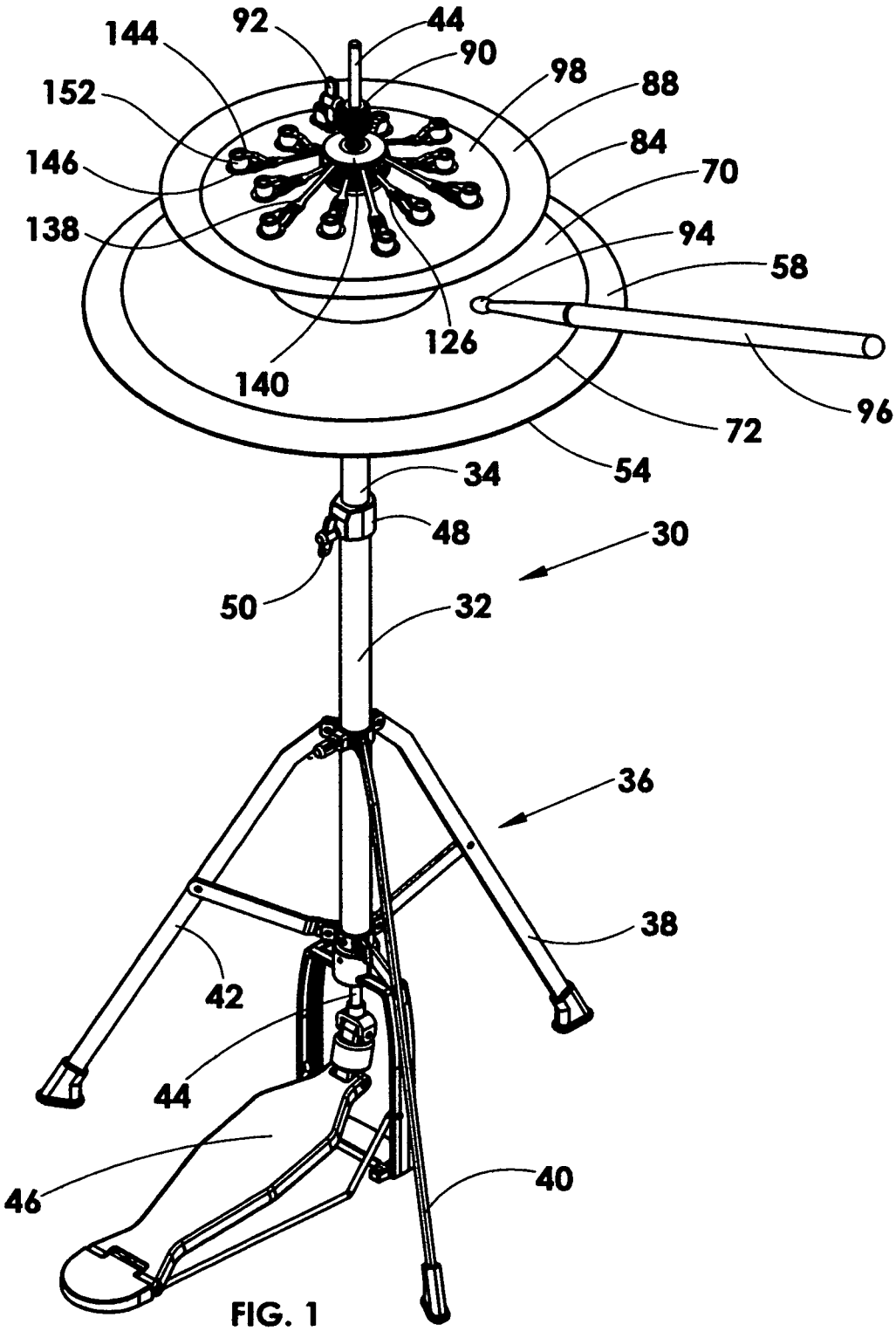
FIG. 1 shows an isometric view of a conventional hi-hat stand on which is mounted the cymbal arrangement of the present invention.
Figure 2:
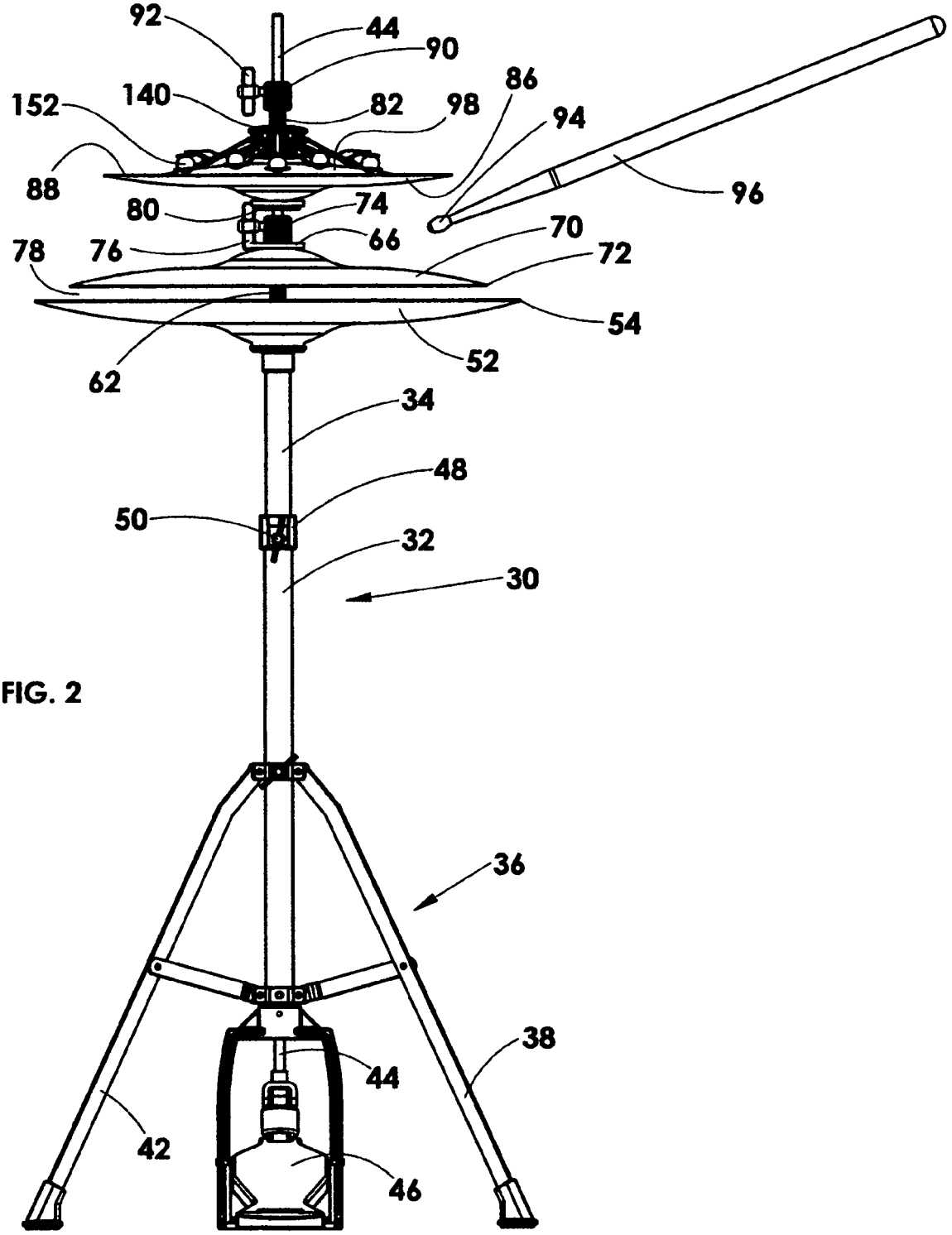
FIG. 2 is front elevation view of the stand of FIG. 1.
Figure 3:
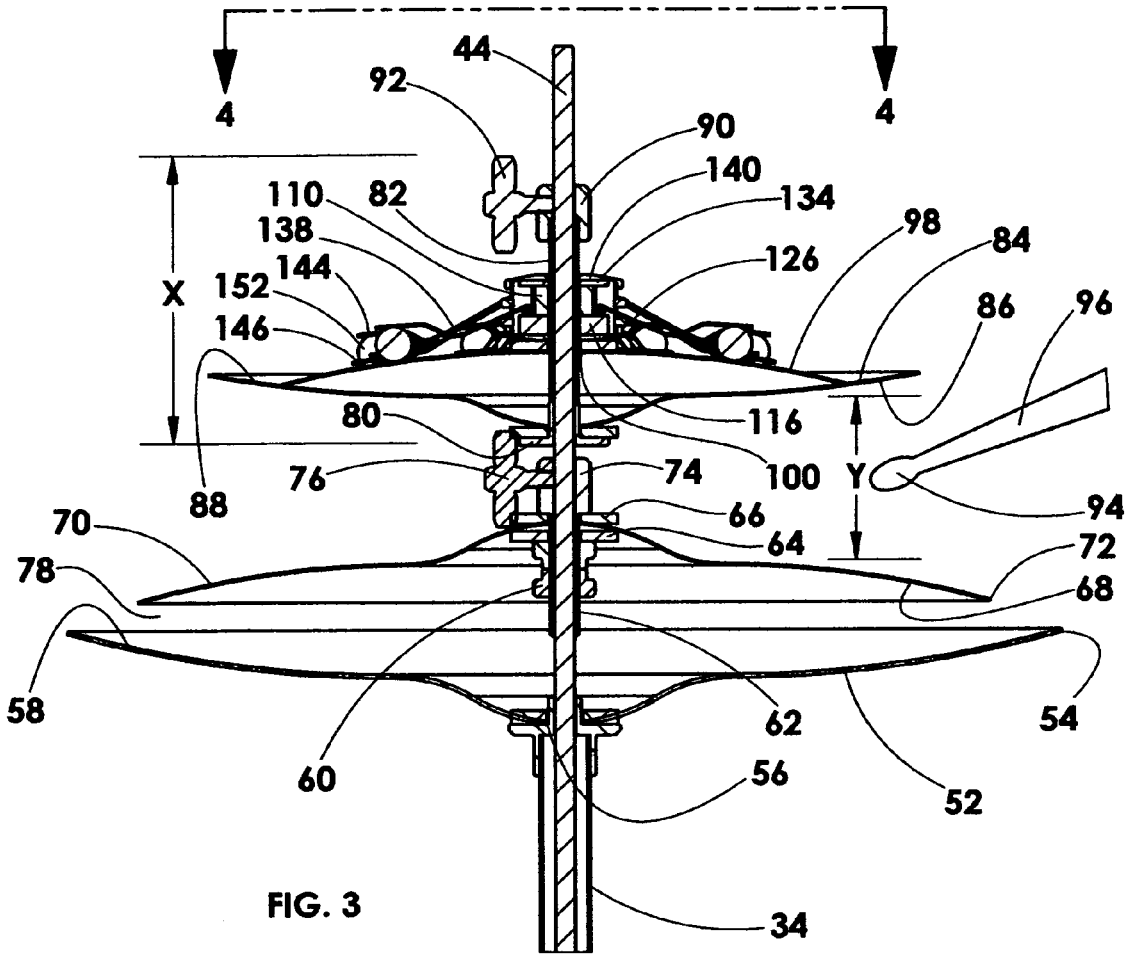
FIG. 3 is a longitudinal cross-sectional view of the cymbal arrangement of this invention which is mounted on the conventional hi-hat shaft or rod.
Figure 4:
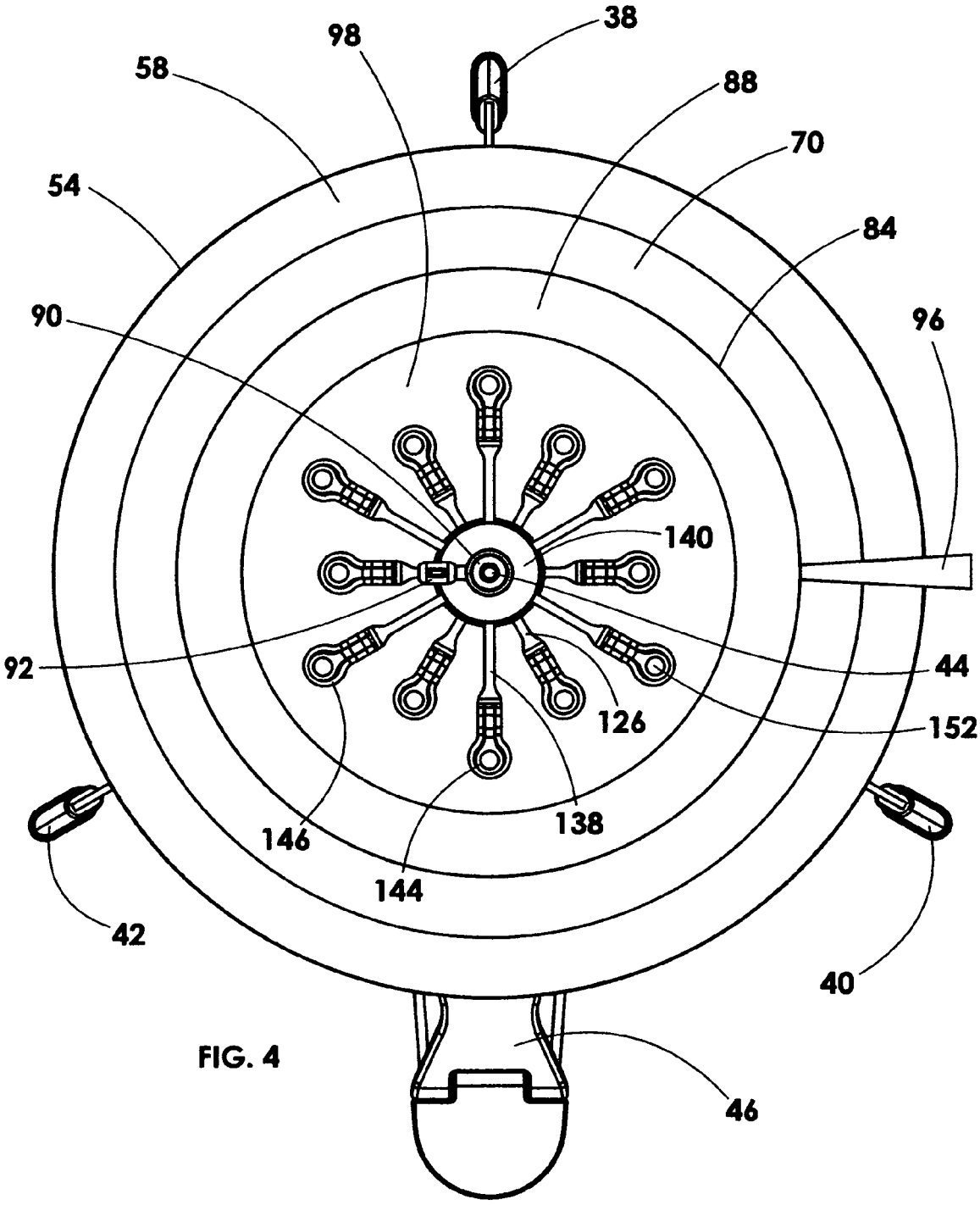
FIG. 4 is a top plan view taken along line 4-4 of FIG. 3.
Figure 5:
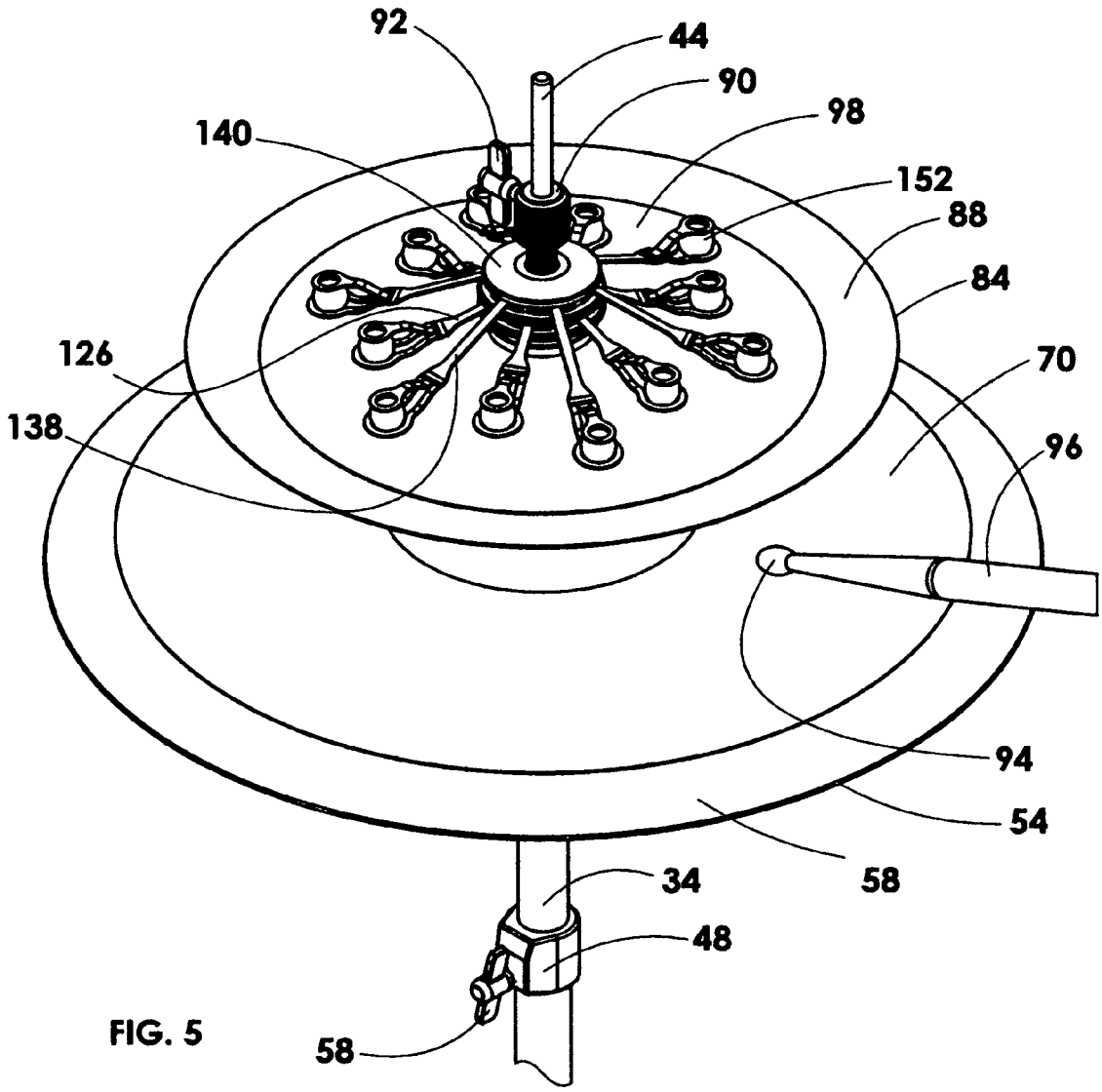
FIG. 5 is an isometric view of the structure shown in FIG. 3.
Figure 6:
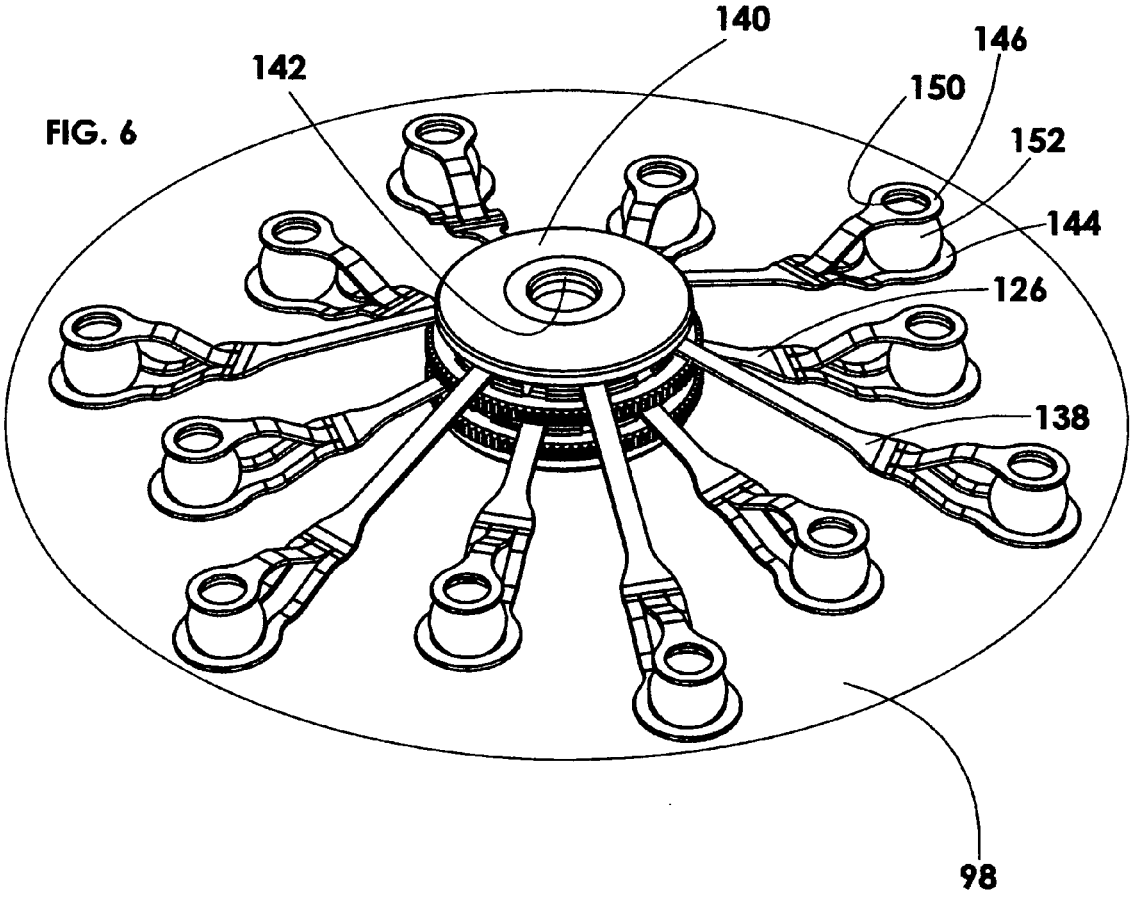
FIG. 6 is an enlarged isometric view of the tuning structure that is mounted on the cymbal plate shown in FIG. 5.
Figure 7:
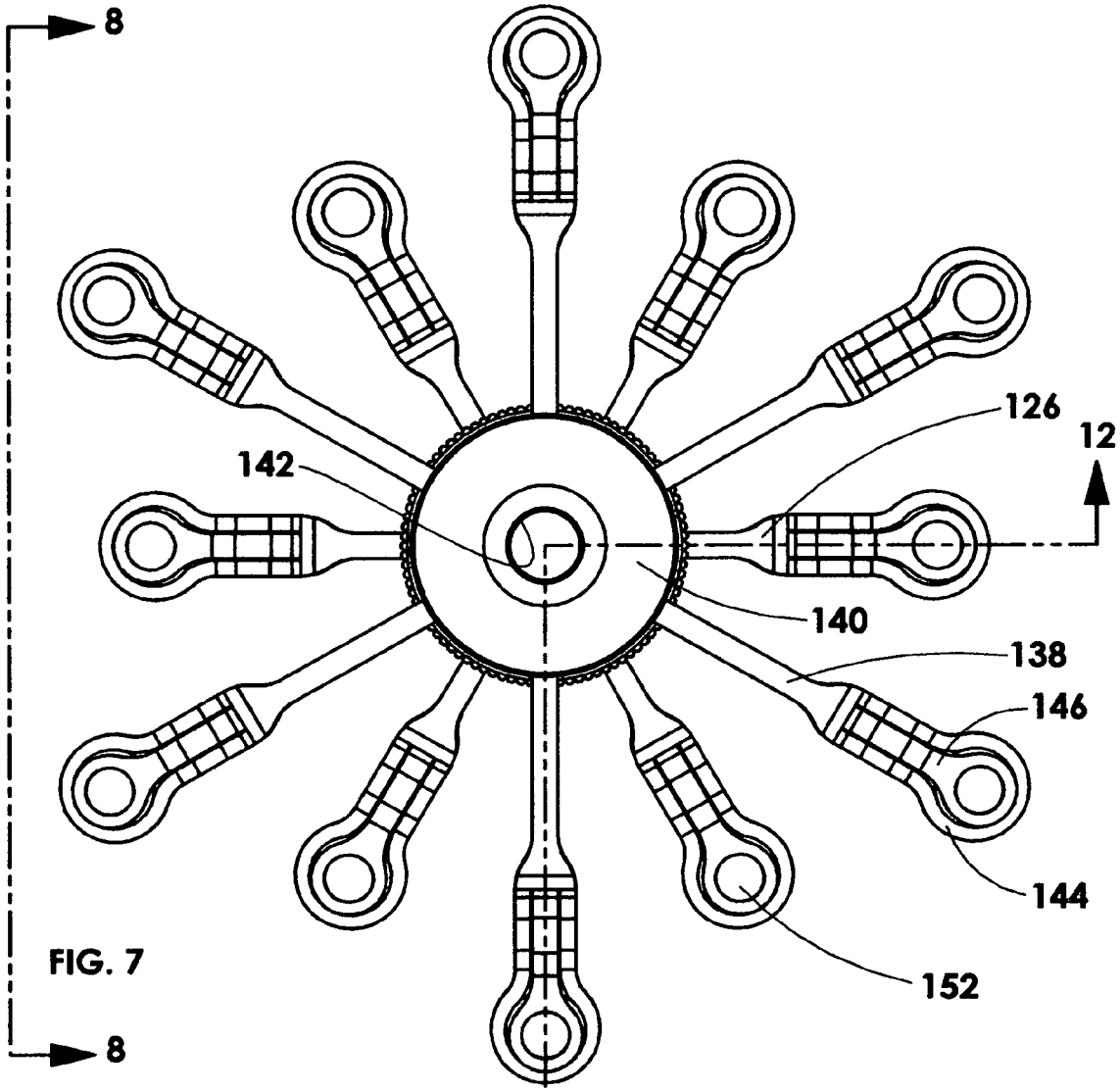
FIG. 7 is a top plan view of the tuning structure shown in FIG. 6.
Figure 8:
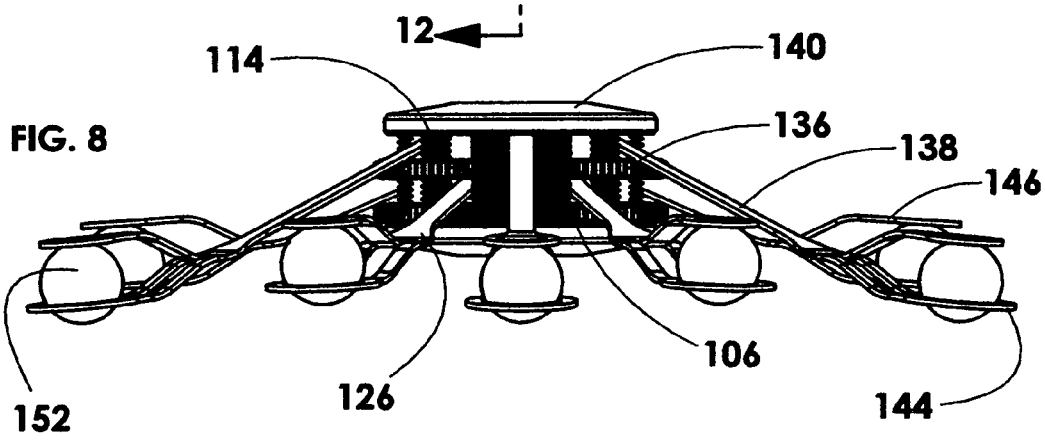
FIG. 8 is a side elevation view of the tuning structure taken along line 8-8 of FIG. 7.
Figure 9:
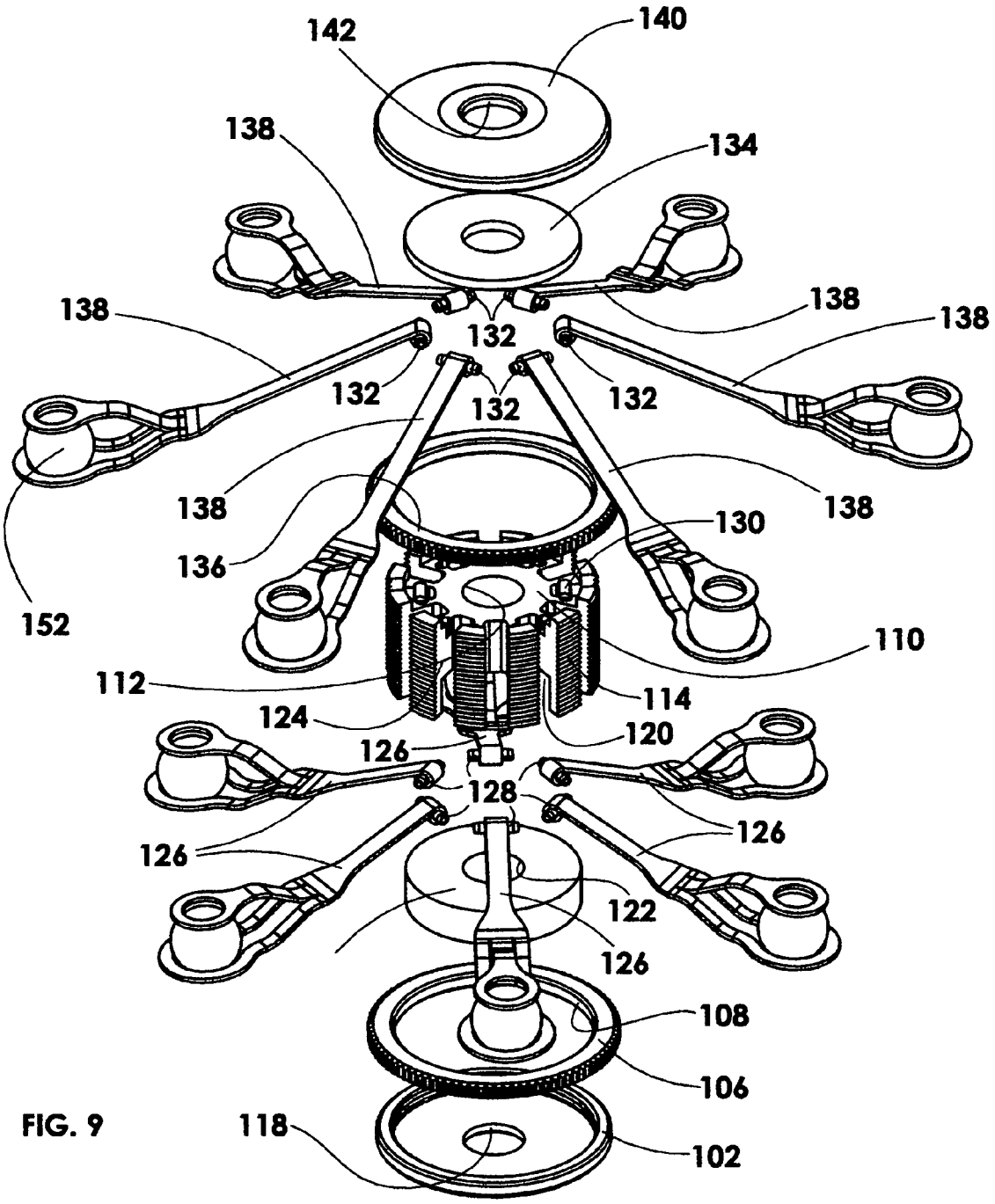
FIG. 9 is an exploded isometric view of the tuning structure shown in FIGS. 6-8.
Figure 10:
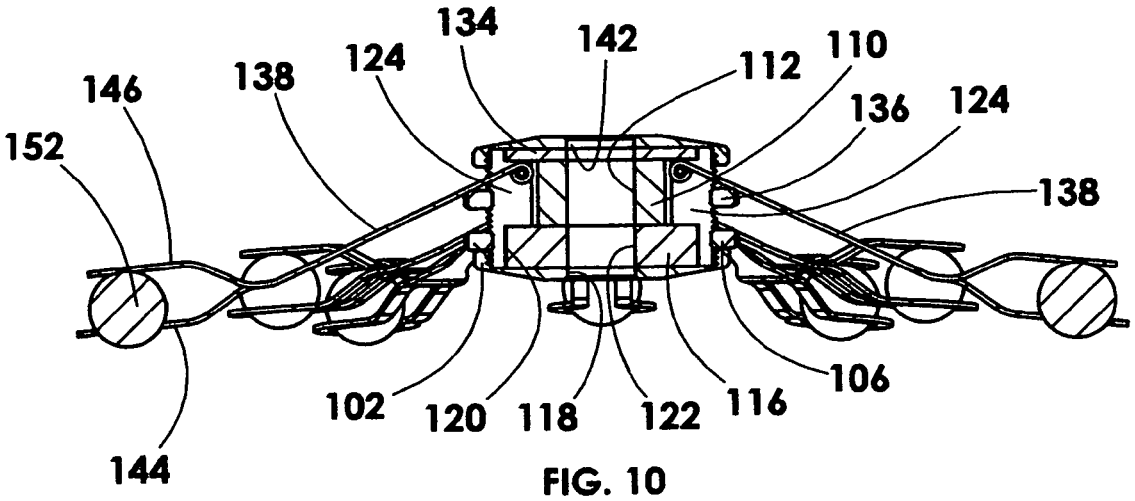
FIG. 10 is a longitudinal cross-sectional view of the structure shown in FIG. 8 showing the tuning structure in a first assembly configuration.
Figure 11:
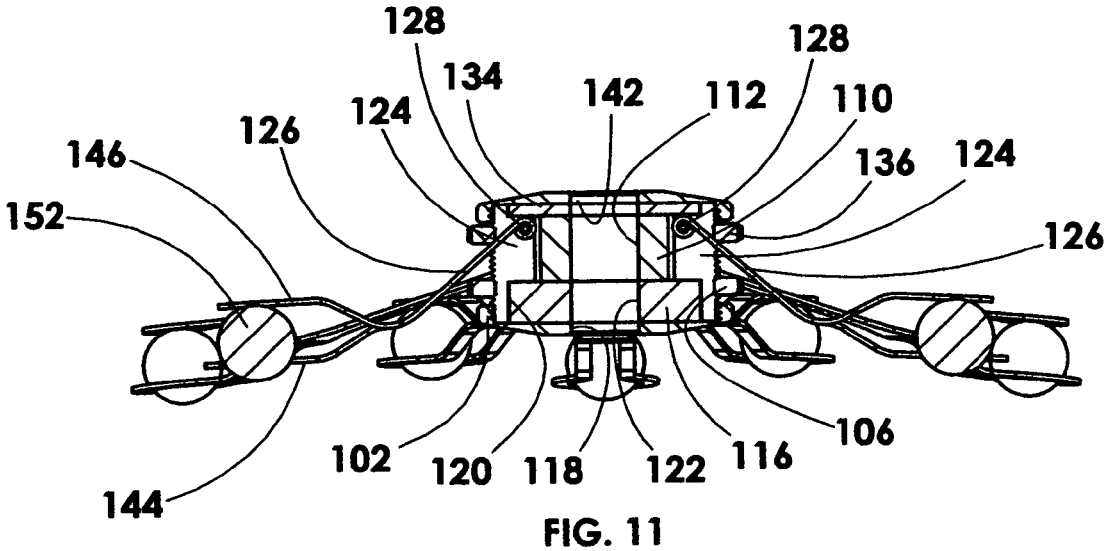
FIG. 11 is a view similar to FIG. 10 but showing the tuning structure in a second assembly configuration.
Figure 12:
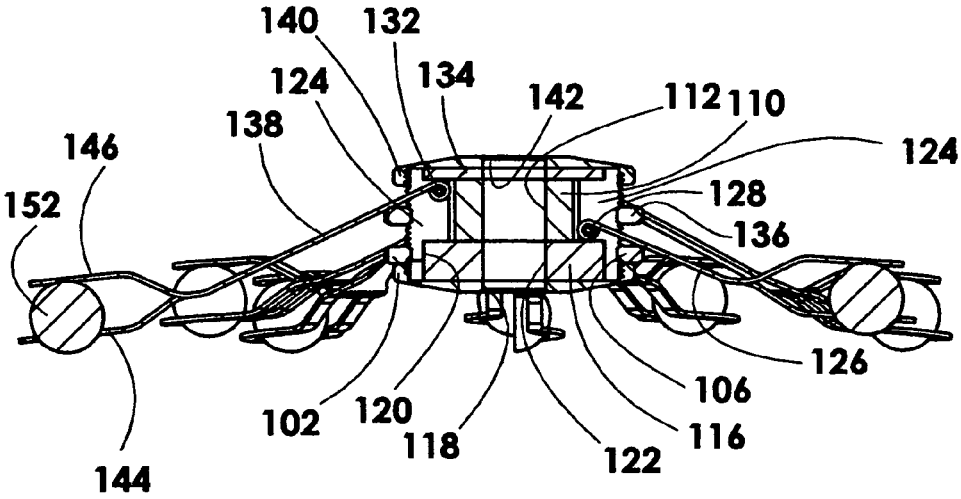
FIG. 12 is a cross sectional view taken along line 12-12 of FIG. 7 showing upper and lower pivot point mountings for the tuning assemblies.
Figure 13:
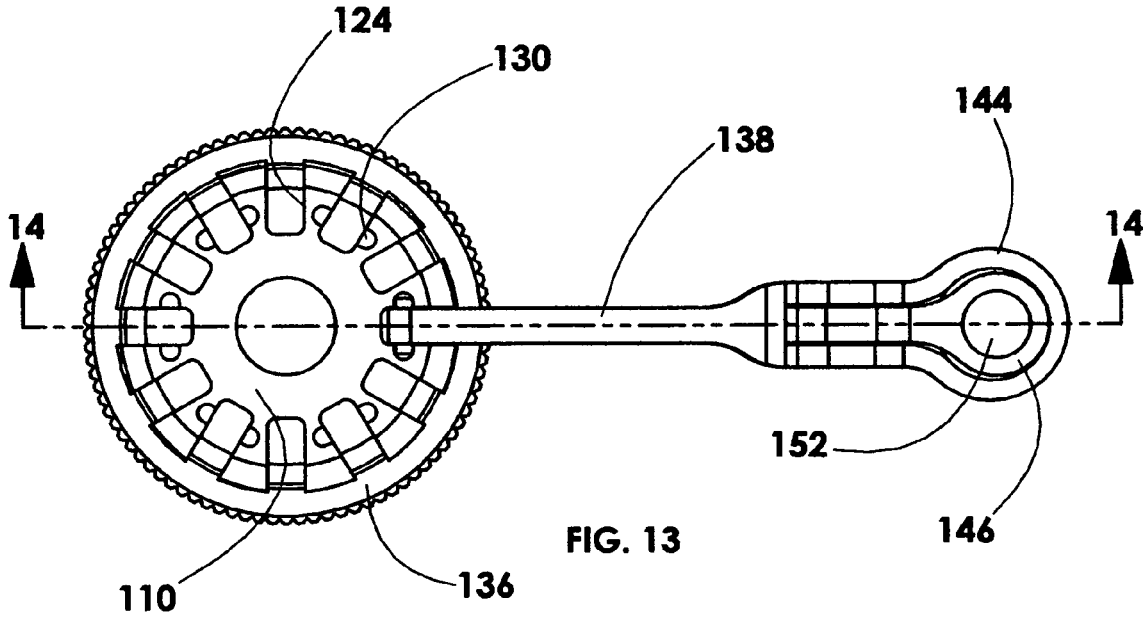
FIG. 13 is a top plan view of one of the tuning arm assemblies shown mounted on a hub assembly which is mounted on the shaft of the cymbal stand.

Referring particularly to the drawings and specifically to FIGS. 1-5, there is shown a cymbal stand 30 which has an outer tube 32. Telescopingly mounted with outer tube 32 is an inner tube 34. Mounted at the lower end of outer tube 32 is a tripod stand 36 which is composed of three in number of tripod legs 38, 40 and 42. Legs 38, 40 and 42 are deemed to be conventional and are movable between a collapsed position (not shown) to an extended position shown in FIGS. 1 and 2. The legs 38, 40 and 42 are to set on a supporting surface (not shown) when in the extended position.

Movably mounted within tubes 32 and 34 is a rod 44 which is also referred to as a shaft. The lower end of rod 44 is attached to a foot pedal 46. Foot pedal 46 is to be moved by the operator's (drummer) foot (not shown) to cause movement of rod 44 within the distance X shown in FIG. 3.

Attached to the upper end of outer tube 32 is a collar 48. Inner tube 34 is mounted within collar 48 and inner tube 34 is slidable relative to collar 48. A set screw 50 is screw threadingly mounted within a hole formed in collar 48. Tightening of set screw 50 will fix outer tube 32 and inner tube 34 together. The use of set screw 50 is to permit height adjustment of the stand 30 to the desires of the operator.

Fixedly mounted at the upper end of inner tube 34 is a lower cymbal 52. Lower cymbal 52 has a circular peripheral edge 54 and a central hole 56. Lower cymbal 52 is disc shaped having a concave inner surface 58.

Fixedly mounted to tube 62 is a collar 60. Tube 62 is movably mounted on rod 44. A pair of discs 64 and 66 are located adjacent collar 60 and also are mounted about rod 44 and are movable relative thereto. Disc 64 is located against the concave undersurface 68 of upper cymbal 70. Disc 68 is positioned against the convex upper surface of upper cymbal 70. Upper cymbal 70 has a peripheral edge 72. It can be seen from the drawings that the diameter of upper cymbal 70 is less than the diameter of lower cymbal 52. Located against disc 66 is a collar 74. Screw threadingly mounted to collar 74 is a set screw 76. Set screw 76 connects to rod 44 to securely bind therewith and is to be loosened to permit adjusting movement of upper cymbal 70 relative to lower cymbal 52 to establish the spacing 78 between upper cymbal 70 and lower cymbal 52. Once this spacing is set, set screw 76 is tightened on rod 44. Operation of foot pedal 46 will cause upper cymbal 70 to clash with lower cymbal 52 producing a sound.

Located above collar 74 is a disc 80. Disc 80 is movably mounted on rod 44. Disc 80 is fixed onto tube 82. Tube 82 is also movably mounted on rod 44. Rod 44 is conducted through a center hole formed in a cymbal plate 84. Cymbal plate 84 has a diameter smaller than upper cymbal 70. However this is not required as it could have a greater diameter or the same diameter. Cymbal plate 84 has a convex lower surface 86 and concave upper surface 88. Cymbal plate 84 rests against disc 80. Cymbal plate 84 is located about tube 82.

The upper end of tube 82 is fixed to a collar 90. Collar 90 is mounted on rod 44 and is movable relative thereto. However, a position established by collar 90 can be fixed by set screw 92. This will establish the thickness of annular space or gap Y between cymbal plate 84 and upper cymbal 70. Normally distance Y will be between two and five inches and is to be selected according to the desires of the drummer. Within the gap Y is to be located the tip 94 of a drumstick 96. Downward movement of the drumstick 96 will cause tip 94 to strike upper cymbal 70 and produce a sound. Upward movement of the drumstick 96 will cause the tip 94 to strike convex bottom surface 86 of cymbal plate 84 again producing a sound. A single stroke of the drumstick 96 is defined as one downward movement and one upper movement of the drumstick 96. Rapid up and down movements of the drumstick will produce a beat.

The tone of the sound produced by the cymbal plate 84 can be varied by a tuning structure to be now described and is specifically shown in the drawings in FIGS. 6 to 29. Tuning structure uses a tuning plate 98. Tuning plate has a center hole 100. Rod 44 and tube 82 is conducted through center hole 100. Tuning plate 98 is movable relative to tube 82. Tuning plate 98 is smaller in diameter than cymbal plate 84. The material of construction of cymbal plate 84, tuning plate 98, upper cymbal 70 and lower cymbal 52 will most likely be a metal.

Bottom cap 102 rests against the convex upper surface of tuning plate 98. Cap 102 has a series of internal threads 104. Lower adjustment nut 106 has a series of internal screw threads 108. A cylindrical shaped hub 110 has a center through hole 112. Hub 110 has a screw threaded peripheral surface 114. A lower containment ring 116 is to be located against the bottom surface of hub 110 and also fit within the cap 102 with threads 104 and 108 engaging with peripheral surface 114. Bottom surface of hub 110 includes a cut-out area 120 within which containment ring 116 is nested. Cap 102 has a center hole 118 through which rod 44 and tube 82 are conducted. Containment ring 116 has a center hole 122 through which rod 44 and tube 82 are conducted. The exterior surface of hub 110 has a series of evenly spaced apart longitudinal slots 124 (twelve in number). Within every other slot 124 is mounted a short arm 126 with there being six in number of short arms 126. The short arms 126 extend radially outward from hub 110. Short arms 126 are identical. The inner end of each short arm 126 is attached to a pin 128. The lower end of each slot 124 has a cut-out (not shown) which connects to cutout area 120. Each pin 128 is to pivotally rest within a not shown cut-out with it being understood that each pin 128 has its own separate not shown cut-out. Because of the slots 124, clearance is provided so each short arm 126 can freely pivot.

The upper end of each slot 124 also has a cut-out 130. A pin 132 is to engage with each cut-out 130 with there being a separate pin 132 for each cut-out 130. There are six in number of cut-outs 130 located evenly spaced apart. Each pin 132 pivots within a cut-out 130. Containment ring 116 keeps the pins 128 in continuous engagement with the slots 124 and cut-out area 120. There is a separate containment ring 134 which is located against the upper surface of hub 110. Adjacent ring 134 and threadedly mounted on hub 110 is an upper adjustment nut 136.

Each pin 132 is mounted at the inner end of a long arm 138. There are six in number of long arms 138. A cap 140 is threadingly secured to hub 110 covering containment ring 134. Cap 140 has a center hole 142 through which rod 44 and tube 82 are conducted.

The outer free end of both arms 126 and 138 are constructed identically. These outer free ends are bifurcated forming a nesting arm 144 and a capturing arm 146. There is a hole 148 formed within nesting arm 144. There is a hole 150 formed in capturing arm 146. Between each pair of a capturing arm 146 and a nesting arm 144 is loosely mounted a ball 152.

Figure 14:
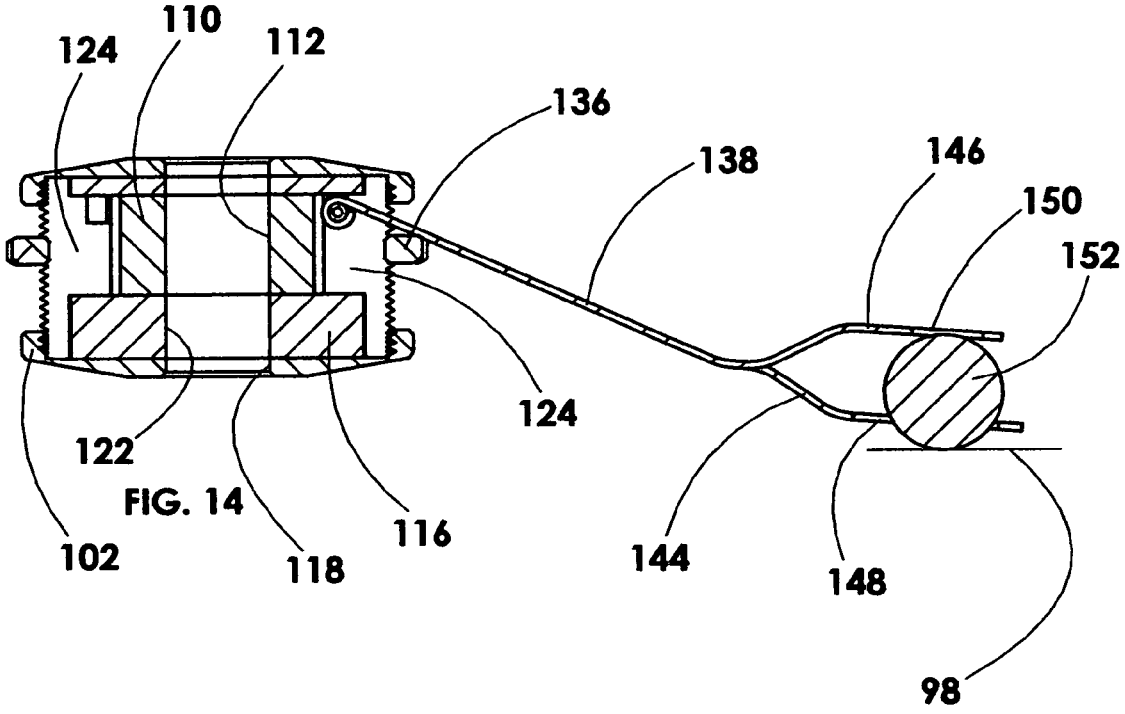
FIG. 14 is an enlarged longitudinal cross-sectional view of only one of the tuning arm assemblies shown in FIG. 10 taken along line 14-14 of FIG. 13.
Figure 15:
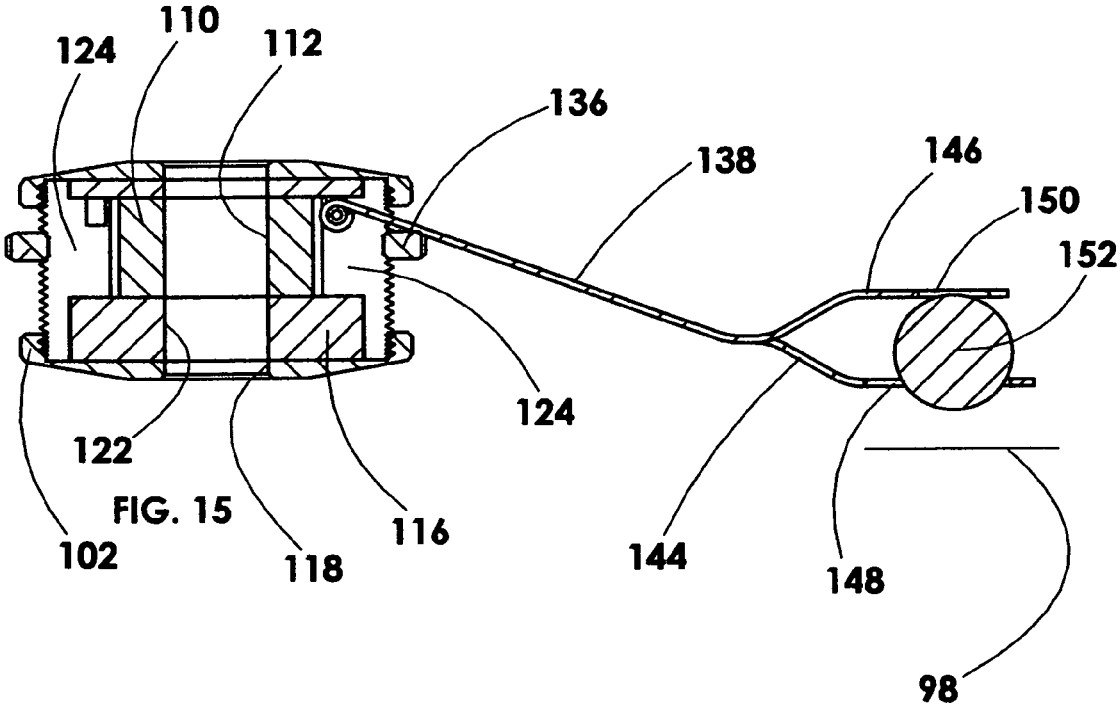
FIG. 15 is a view similar to FIG. 13 but showing the tuning arm in a more horizontal position when compared to FIG. 14.

Arms 138 can be located above and just rest on adjustment nut 136 as is shown in FIGS. 14 and 15. As the adjustment nut 136 is adjusted upwardly the ball 152 can be made to just touch the tuning plate 98 as is shown in FIG. 14 or float above the tuning plate 98 as is shown in FIG. 15. The result in both situations is the production of a clatter type of sound with there being a difference between FIGS. 14 and 15. The lower adjustment nut 106 is left out in FIGS. 14 and 15 for clarity.

Figure 16:
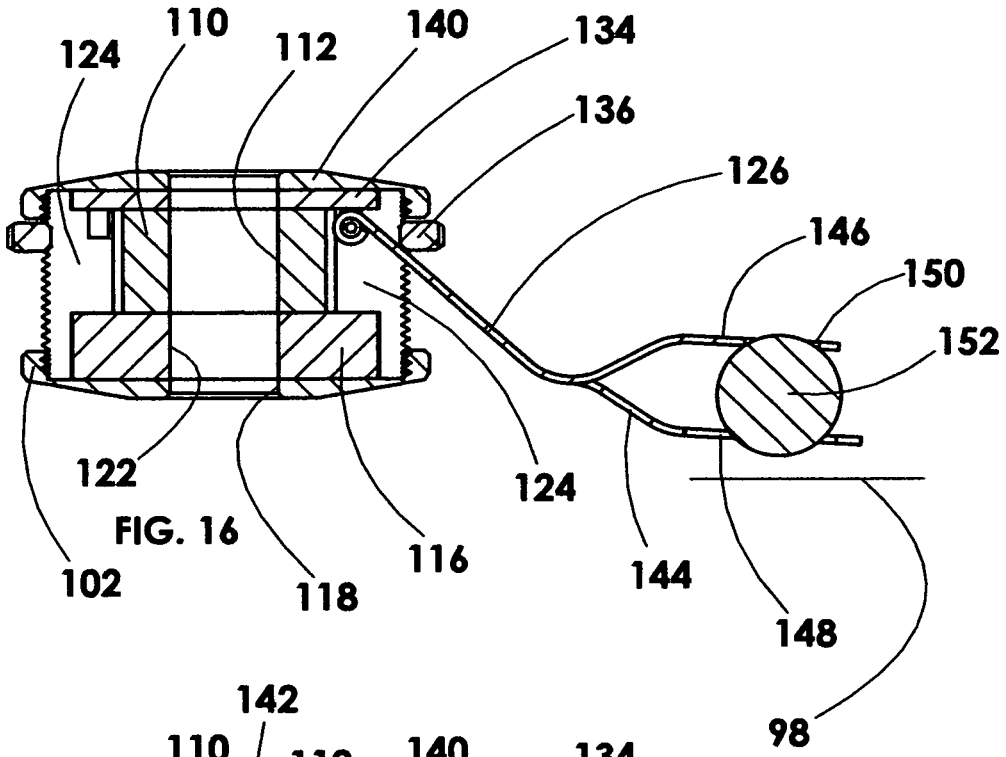
FIG. 16 is a view similar to FIG. 14 but showing a second assembly configuration which was shown in FIG. 11.
Figure 17:
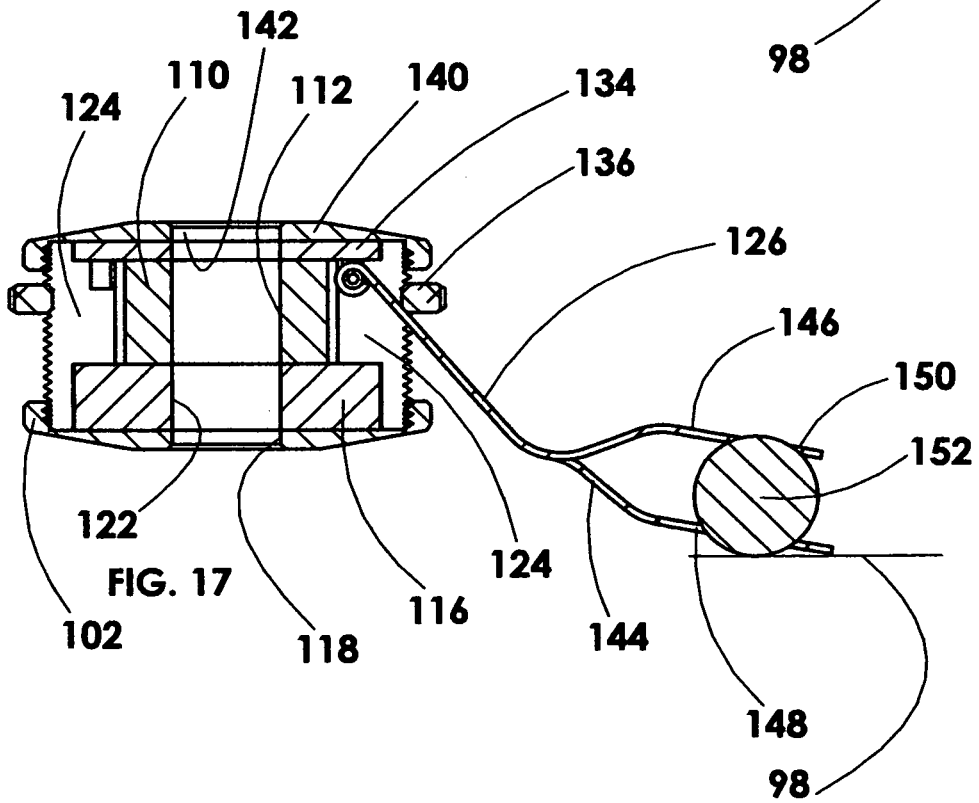
FIG. 17 is a view similar to FIG. 16 but showing the tuning arm further slanted.

Referring particularly to FIGS. 16 and 17 the short arms 126 are mounted under-neath the adjustment nut 136 which will press the balls 152 against the tuning plate 98 again producing a different sound. The balls 152 are press tighter against the tuning plate 98 in FIG. 17 as opposed to FIG. 16 which will produce a different sound.

Adjustment nuts 106 and 136 can be located above or below their respective arms 126 and 138 at the choice of the drummer. In this way the drummer can achieve a unique sound.

Figures 18, 19, 20, 21, 22, 23:
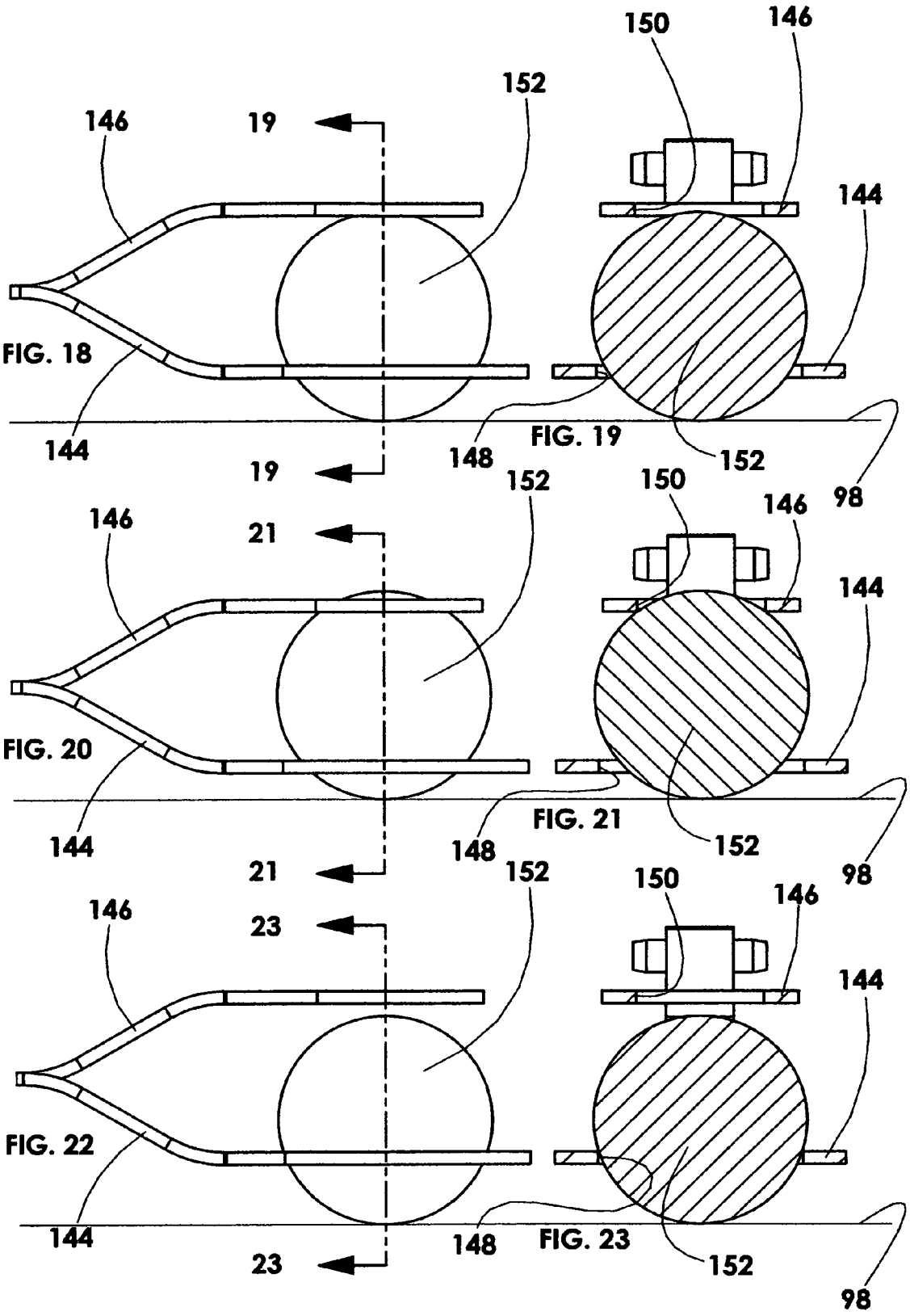
FIG. 18 is an enlarged view of the outer free end of a first embodiment of tuning arm that is shown in FIGS. 1 to 17 showing the arm in a first position.
FIG. 19 is a cross-sectional view taken along line 19-19 of FIG. 18.
FIG. 20 is an enlarged view similar to FIG. 18 showing the arm in a second Position.
FIG. 21 is a cross-sectional view taken along line 21-21 of FIG. 20.
FIG. 22 is an enlarged view similar to FIGS. 18 and 20 showing the arm in a third position.
FIG. 23 is a cross-sectional view taken along line 23-23 of FIG. 22.

FIGS. 18 to 23 show different positions of the ball 152 relative to tuning plate 98. The ball 152 positions in each Figure will emit a different sound. Ball 152 is tight against tuning plate 98 in FIGS. 20 and 21 where within FIGS. 22 and 23 the ball 152 is loosely resting on the tuning plate 98. FIGS. 18 and 19 show the ball 152 in an intermediate position compared to FIGS. 20 and 22.

Figure 24:
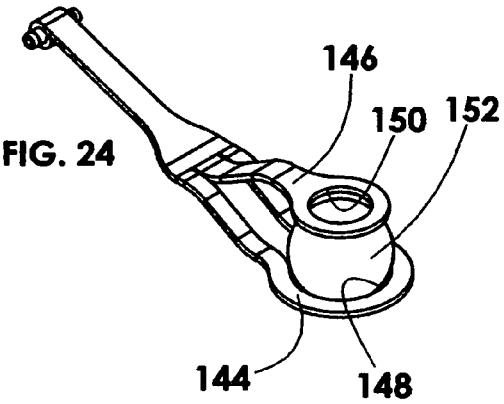
FIG. 24 is an isometric view of the embodiment of arm assembly used in FIGS. 1 to 23 of the drawings.

FIG. 24 is an isometric view of an arm assembly by itself that is represented in FIGS. 1-23.

Figure 25:
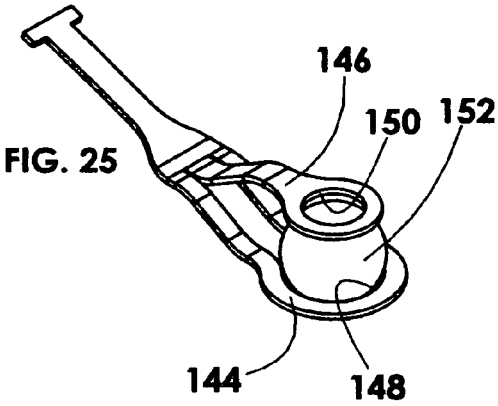
FIG. 25 is a view similar to FIG. 24 but showing a different form of connector at the rear of the arm assembly for connection to the hub assembly.

FIG. 25 is an isometric view of an arm assembly similar to FIG. 24 but where the aft end of the arm includes a T-shaped connector rather than a through hole that connects to a pin 128 or 132 shown in FIGS. 1-23.

Figure 26:
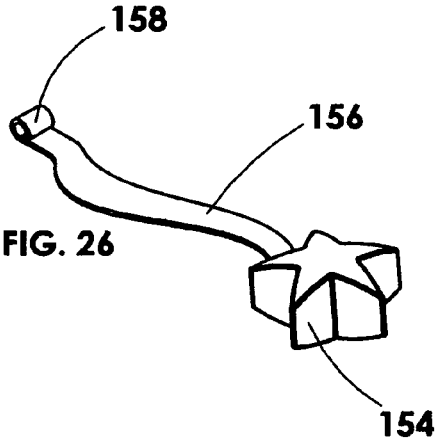
FIG. 26 is an isometric view of a second embodiment of arm assembly.

Referring particularly to FIG. 26 there is shown a different configuration of a star shaped member 154 substituting for the ball 152. Arm 156 is also of a different configuration. A pin, not shown, is to be mounted in end 158.

Figure 27:
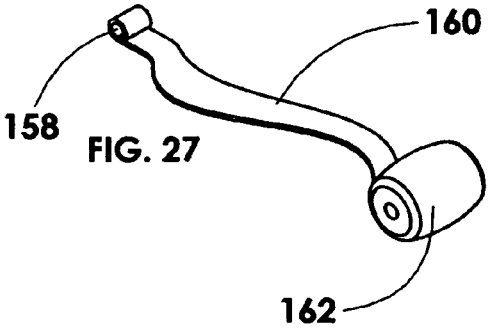
FIG. 27 is an isometric view of a third embodiment of arm assembly.
Figure 29:
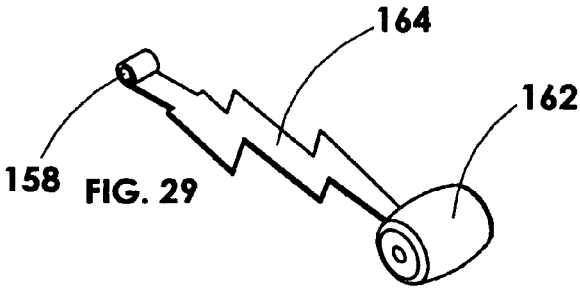
FIG. 29 is an isometric view of a fifth embodiment of arm assembly.

Referring particularly to FIG. 27 there is shown a still different configuration using a different shape of arm 160 and a cylinder 162 instead of a ball FIG. 29 shows the cylinder 162 with a different shape of arm 164.

Figure 28:
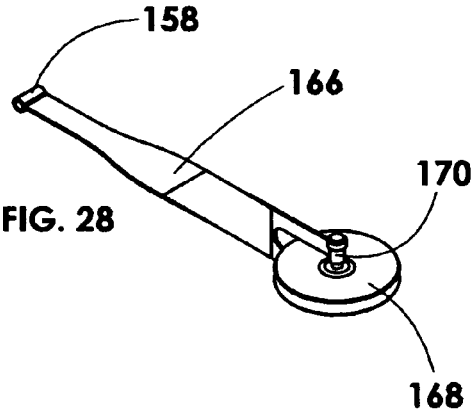
FIG. 28 is an isometric view of a fourth embodiment of arm assembly.

FIG. 28 shows a different shaped arm 166 and instead of a ball uses a plurality of discs 168 which are loosely mounted between a pair of prongs 170 with only one prong being shown.

The units shown in FIGS. 24 to 29 all produce a different sound which can be selected by the drummer or other operator.

The invention claimed is:

1. In combination with a percussion musical instrument which has a shaft on which is mounted a cymbal, a cymbal plate is also mounted on said shaft, said cymbal plate being located a short distance from said cymbal producing an annular gap, said cymbal having a convex upper surface and said cymbal plate having a convex lower surface, said convex upper surface facing said convex lower surface, whereby a tip of a drumstick is adapted to be inserted within said annular gap and is to be movable between said cymbal and said cymbal plate striking both said cymbal plate and said cymbal during the motion of a single stroke of the drumstick producing a sound from both said cymbal and said cymbal plate, including a tuning structure mounted in conjunction with said cymbal plate, said tuning structure being adjustable to vary the pitch of the sound produced from said cymbal plate when struck by the drumstick;

wherein said tuning structure includes:

a tuning plate mounted on said shaft, said cymbal plate having an upper surface, said tuning plate being in contact with said cymbal plate; and an arm assembly mounted on said shaft, said arm assembly defining a plurality of spaced apart arm members which extend radially from said shaft, each arm member of said arm members having a free outer end, each said free outer end being in contact with said tuning plate and the pitch of the sound is determined by the contactual pressure of said free outer ends on said tuning plate which is transferred to said cymbal plate.

2. The combination as defined in claim 1 wherein:

an adjusting mechanism is attached to said arm members, manual adjustment of said adjusting mechanism will vary the pressure of said free outer ends on said tuning plate which varies the pressure of said tuning plate on said cymbal plate which will vary the pitch of the sound emitted by said cymbal plate.

3. The combination as defined in claim 1 wherein; each said free outer end includes a pivotable member.

4. The combination as defined in claim 3 wherein; said pivotable member comprises a ball.

5. The combination as defined in claim 3 wherein: said pivotable member comprises a cylinder.

6. The combination as defined in claim 3 wherein; said pivotable member comprises a pair of discs closely mounted together.

7. The combination as defined in claim 1 wherein: said upper surface of said tuning plate being concave.

8. The combination as defined in claim 1 wherein: said arm members varying in length.

9. In combination with a percussion musical instrument which has a rod on which is mounted a cymbal, a cymbal plate is also mounted on said rod, said cymbal plate being located a short distance from said cymbal producing an annular gap, a tuning structure mounted in conjunction with said cymbal plate, said tuning structure being adjustable to vary the pitch of the sound produced from said cymbal plate when struck by a drumstick, whereby a tip of a drumstick is adapted to be inserted within said annular gap and is to be movable between said cymbal and said cymbal plate striking both said cymbal and said cymbal plate during the motion of a single stroke of the drumstick producing a sound from both said cymbal and said cymbal plate;

wherein said tuning structure comprises:

a tuning plate mounted on said rod, said cymbal plate having an upper surface, said tuning plate being in contact with said cymbal plate, and an arm assembly mounted on said rod, said arm assembly defining a plurality of spaced apart arm members which extend radially from said rod, each arm member of said arm members have a free outer end, each said free outer end being in contact with said tuning plate and the pitch of the sound is determined by the contactual pressure of said free outer ends on said tuning plate which is transferred to said cymbal plate.

10. The combination as defined in claim 9 wherein: an adjusting mechanism is attached to said arm members, manual adjustment of said adjusting mechanism will vary the pressure of said free outer ends on said tuning plate which varies the pressure of said tuning plate on said cymbal plate which will vary the pitch of the sound emitted by said cymbal plate.

11. The combination as defined in claim 9 wherein: each said free outer end including a pivotable member.

12. The combination as defined in claim 9 wherein:

said upper surface of said tuning plate being concave.

* * * * *